US012532994B2

(12) United States Patent
Wang et al.

(10) Patent No.: US 12,532,994 B2
(45) Date of Patent: Jan. 27, 2026

(54) CLEANING BRUSH AND KIT THEREOF

(71) Applicant: Ningbo Shijia Cleaning Tools Co., Ltd., Zhejiang (CN)

(72) Inventors: Siwen Wang, Zhejiang (CN); Yongdong Wang, Zhejiang (CN); Hui Hu, Zhejiang (CN)

(73) Assignee: Ningbo Shijia Cleaning Tools Co., Ltd, Ningbo (CN)

( * ) Notice: Subject to any disclaimer, the term of this patent is extended or adjusted under 35 U.S.C. 154(b) by 409 days.

(21) Appl. No.: 18/088,929

(22) Filed: Dec. 27, 2022

(65) Prior Publication Data

US 2024/0065495 A1 Feb. 29, 2024

(30) Foreign Application Priority Data

Aug. 26, 2022 (CN) ..... 202222257832.4

(51) Int. Cl.

| | |
|---|---|
| ***A47K 17/00*** | (2006.01) |
| ***A46B 15/00*** | (2006.01) |
| ***A46D 1/00*** | (2006.01) |
| ***A47K 11/10*** | (2006.01) |

(52) U.S. Cl.

CPC ..... *A47K 17/00* (2013.01); *A46B 15/0095* (2013.01); *A46D 1/0238* (2013.01); *A47K 11/10* (2013.01); *A46B 2200/304* (2013.01)

(58) Field of Classification Search

CPC .. A47K 11/10; A47K 17/00; A46B 2200/304; A46B 15/0095; A46D 1/0238

USPC ..... 248/205.8, 206.2–206.3

See application file for complete search history.

(56) References Cited

U.S. PATENT DOCUMENTS

2015/0230688 A1* 8/2015 Vitale ..... A46B 17/08 206/361
2019/0315516 A1* 10/2019 Tapia ..... A47K 5/12

FOREIGN PATENT DOCUMENTS

| | | | | |
|---|---|---|---|---|
| CN | 106820565 A | * | 6/2017 | ..... A46B 17/00 |
| CN | 210748983 U | * | 6/2020 | ..... A47K 11/10 |
| CN | 213551509 U | * | 6/2021 | ..... A47K 17/00 |
| DE | 202017000362 U1 | * | 1/2017 | ..... A47K 1/09 |
| DE | 202019104972 U1 | * | 9/2019 | ..... A46B 7/00 |
| JP | 2007021141 A | * | 2/2007 | ..... A47K 11/10 |
| WO | WO 2008012161 A | * | 1/2008 | ..... A47K 11/10 |

OTHER PUBLICATIONS

English translation of DE 202019104972 U1 , Li, Sep. 18, 2019. (Year: 2019).*
English translation of WO 2008012161 A1, Huller, Jan. 31, 2008. (Year: 2008).*
English translation of DE 202017000362 U1, Gosdin, Jan. 30, 2017. (Year: 2017).*

* cited by examiner

*Primary Examiner* — Laura C Guidotti

(57) ABSTRACT

A cleaning brush includes a brush handle, a brush head connected to the brush handle, and a plurality of bristles attached to the surface of the brush head, the cross section of the bristles in at least some areas on the surface of the brush head is polygonal; a cleaning brush kit includes the cleaning brush and a storage box corresponding to the cleaning brush; a side wall of the storage box is provided with an adsorption member, and the adsorption member enables the storage box to be attached to a smooth and hard surface.

9 Claims, 4 Drawing Sheets

CLEANING BRUSH AND KIT THEREOF

TECHNICAL FIELD

The present disclosure relates to the technical field of toilet cleaning appliances, in particular to a cleaning brush and a kit thereof.

BACKGROUND

As part of household cleaning, it is often necessary to clean a toilet to ensure cleanliness and good hygiene. A cleaning brush is a common tool for cleaning the toilet. The brush head of the existing cleaning brush typically has a cylindrical structure. When the cleaning brush cleans the toilet, the contact area between the brush head and the toilet is small, that the actual action surface of the brush head during cleaning is small. Additionally, the existing kits for storing the cleaning brush are placed on the ground.

SUMMARY

The purpose of the present disclosure is to provide a cleaning brush and a kit thereof. The structure of bristles is improved to increase the action area thereof during cleaning, thereby improving the washing effect. On the other hand, the adsorption member enables the storage box to be attached to a smooth and hard surface, so as to solve the problem of being easily kicked down.

The above technical purpose of the present disclosure is realized through the following technical scheme. Embodiment 1: a cleaning brush, comprising a brush handle, a brush head connected to the brush handle, and a plurality of bristles attached to the surface of the brush head, wherein the cross section of the bristles in at least some areas on the surface of the brush head is polygonal.

Further, the brush head is flat, and the cross section of the bristles at least perpendicular to the upper surface and/or the lower surface of the brush head is polygonal.

Further, the cross sections of all bristles located on the surface of the brush head are polygonal.

Further, the polygon is rectangular.

Embodiment 2: a cleaning brush kit, comprising the cleaning brush described in Embodiment 1 and a storage box matched with the cleaning brush, wherein the side wall of the storage box is provided with an adsorption member, and the adsorption member enables the storage box to be attached to a smooth and hard surface.

Further, the storage box is provided with a socket with a lower end or a side end opened, and the adsorption member is provided with a plug-in block which is matched with the socket in a plug-in manner.

Further, the adsorption member is a suction cup.

Further, the storage box comprises a seat body, a barrel body and an elastic element, the seat body is movably sleeved with the barrel body, the elastic element is provided between the seat body and the barrel body, the barrel body is provided with an inner barrel placed in the seat body, the inner barrel is provided with an accommodating cavity, the upper end of the seat body is hinged with a barrel cover, the barrel cover opens and closes as the barrel body moves up and down, the seat body is provided with an air vent at the lower end of the barrel cover, and when the cleaning brush is placed in the inner barrel, the barrel body moves downward with respect to the seat body against the elastic force of the elastic element, so as to drive the barrel cover to be closed at the upper end of the seat body and enable the vent hole to communicate the inner barrel with the outside of the seat body.

Further, the seat body comprises a base and a bracket placed on the base, the air vent is provided at the upper part of the bracket, the bucket cover is hinged to the upper end of the bracket, the inner barrel is sleeved inside the bracket, a mounting block extends outward from the side end of the bracket, the barrel body is provided with an escaping groove into which the mounting block protrudes, and the socket is provided in the mounting block.

Further, the barrel cover is provided with an abutting part corresponding to the hinged end thereof, the barrel body is provided with an inclined surface part which abuts against the abutting part and is matched therewith in a guiding manner, and the inclined surface part inclines upward from inside to outside.

To sum up, the present disclosure has the following beneficial effects.

1. The cleaning brush of the present disclosure improves the structure of the bristles to increase the action area thereof during washing, thereby improving the washing effect.
2. According to the cleaning brush kit of the present disclosure, the adsorption member enables the storage box to be attached to a smooth and hard surface, so as to solve the problem of being easily kicked down.

In the figures: 1. Brush handle; 11. Unit brush handle; 2. Brush head; 3. Bristle; 4. Adsorption member; 41. Plug-in block; 5. Storage box; 51. Seat body; 511. Base; 512. Bracket; 5121. Air vent; 5122. Through hole; 513. Mounting block; 5131. Socket; 52. Barrel body; 521. Inner barrel; 522. Inclined surface part; 53. Elastic element; 54. Barrel cover; 541. Abutting part.

DETAILED DESCRIPTION

The present disclosure will be further explained with reference to the attached drawings.

Figure 1:
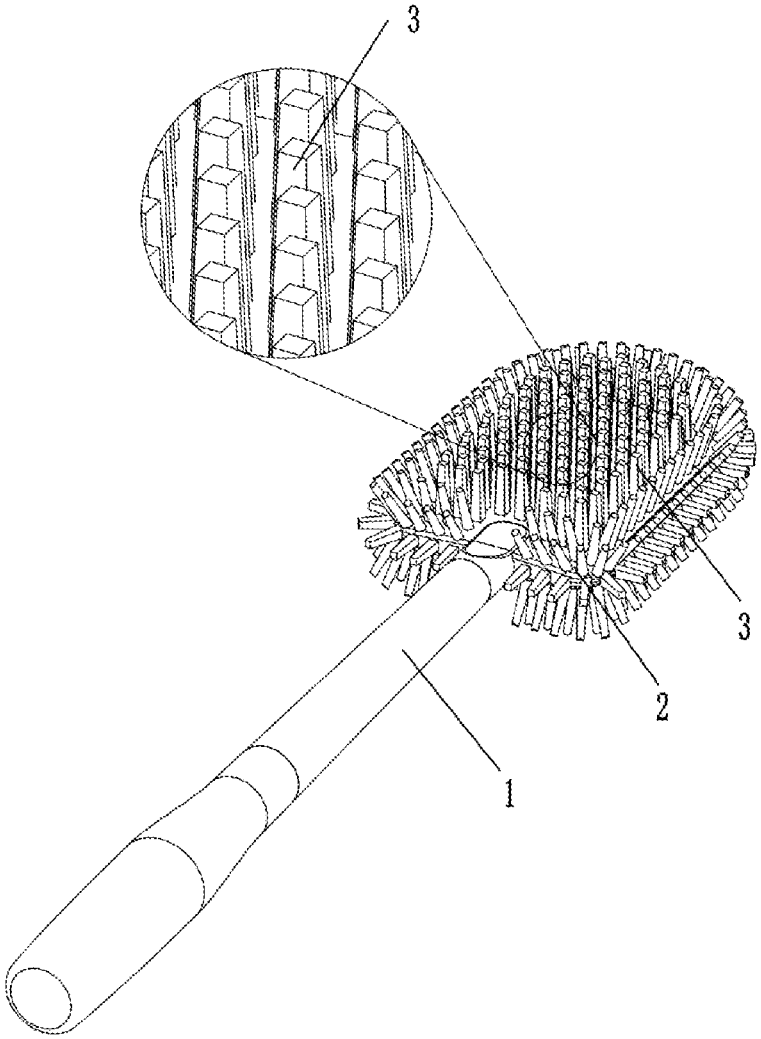
FIG. 1 is a structural schematic diagram of a cleaning brush according to the present disclosure.
Figure 2:
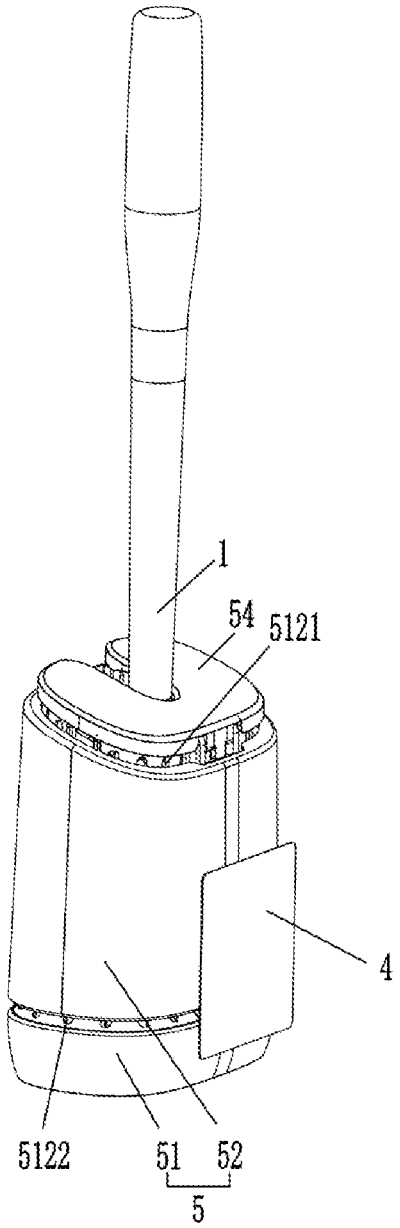
FIG. 2 is a structural schematic diagram according to the present disclosure when a cleaning brush is installed in a cleaning brush kit.
Figure 3:
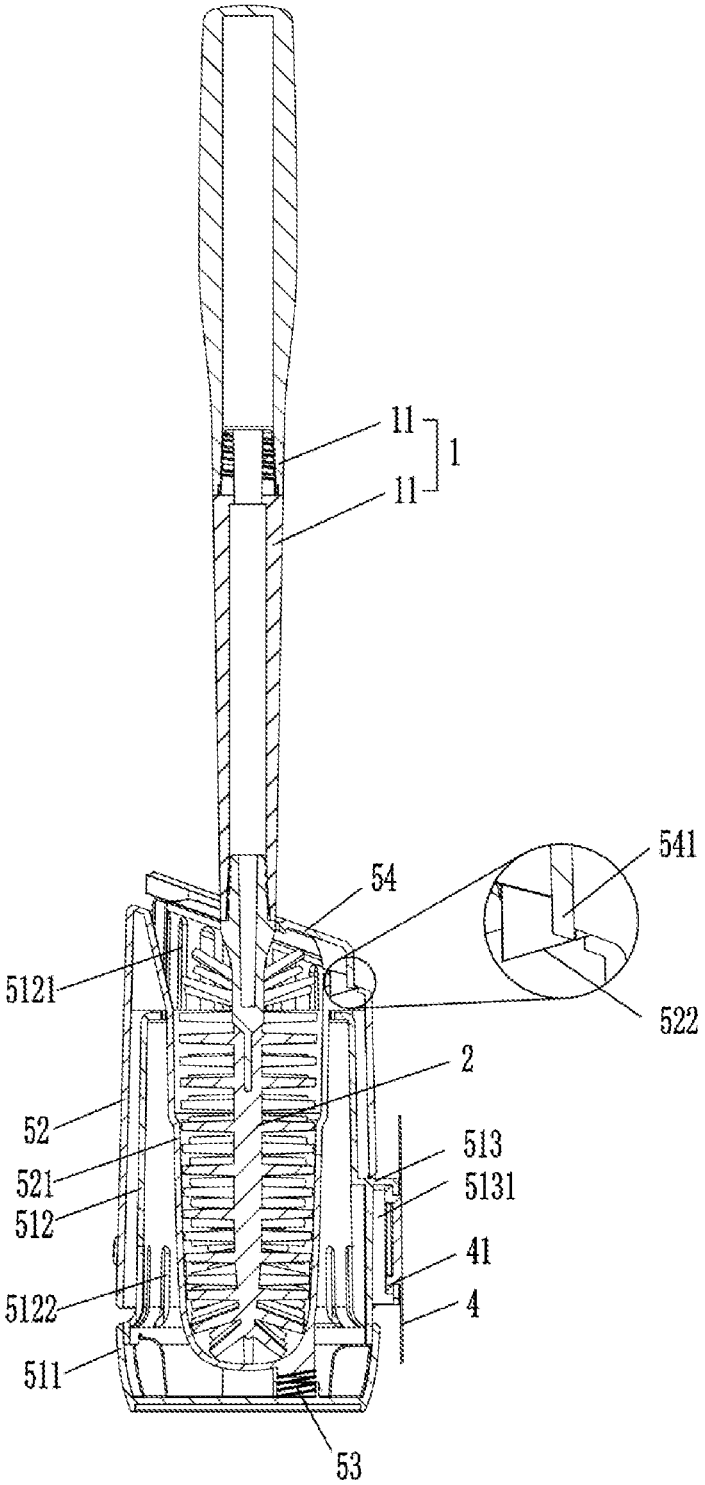
FIG. 3 is a cross-sectional view of a cleaning brush and a cleaning brush kit according to the present disclosure.
Figure 4:
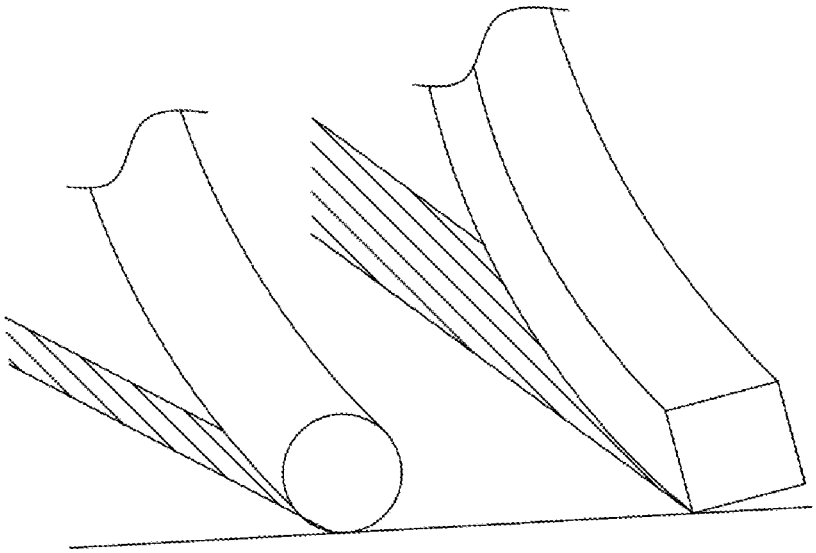
FIG. 4 is a schematic diagram of an action area when the bristles according to the present disclosure and the bristles of the prior art are attached to the object to be washed.

As shown in FIGS. 1-4, Embodiment 1 comprises a brush handle 1, a brush head 2 connected to the brush handle 1, and a plurality of bristles 3 attached to the surface of the brush head 2. The cross section of the bristles 3 in at least some areas on the surface of the brush head 2 is polygonal. The polygon can be rectangular or other shapes.

In the present disclosure, the brush head 2 is flat, and the cross section of the bristles 3 at least perpendicular to the upper surface and/or the lower surface of the brush head 2 is polygonal. Further, the cross sections of all bristles 3 located on the surface of the brush head 2 are polygonal.

The cleaning brush of the present disclosure improves the structure of the bristles 3 to increase the action area thereof during washing, that is, the contact area between the bristles 3 and the object to be washed is increased during washing, thereby improving the washing effect.

The brush handle 1 comprises a plurality of unit brush handles 11, and the unit brush handles 11 can be detachably assembled into the brush handle 1. The adjacent unit brush handles 11 can be connected by screws or by connectors. The brush handle 1 is designed into the structure of a multi-section detachable unit brush handle 11, which can reduce the packaging cost and the transportation cost.

Embodiment 2: A cleaning brush kit comprises the cleaning brush described in Embodiment 1, and a storage box 5 matched with the cleaning brush. The side wall of the storage box 5 is provided with an adsorption member 4, and the adsorption member 4 enables the storage box 5 to be attached to a smooth and hard surface. According to the cleaning brush kit of the present disclosure, the adsorption member 4 enables the cleaning brush kit to be attached to a smooth and hard surface, so as to solve the problem of being easily kicked down. The smooth hard surface comprises for example a ceramic tile surface, a wall surface, etc.

The storage box 5 is provided with a socket 5131 with a lower end or a side end opened, and the adsorption member 4 is provided with a plug-in block 41 which is matched with the socket 5131 in a plug-in manner. Through the above arrangement, it is convenient to assemble and disassemble the adsorption member 4. In the present disclosure, the adsorption member is a suction cup 4.

The storage box 5 comprises a seat body 51, a barrel body 52 and an elastic element 53. The seat body 51 is movably sleeved with the barrel body 52, that is, the barrel body 52 can move up and down with respect to the seat body 51. The elastic element 53 is provided between the seat body 51 and the barrel body 52. The barrel body 52 is provided with an inner barrel 521 placed in the seat body 51. The inner barrel 521 is provided with an accommodating cavity. The upper end of the seat body 51 is hinged with a barrel cover 54. The barrel cover 54 opens and closes as the barrel body 52 moves up and down. The seat body 51 is provided with an air vent 5121 at the lower end of the barrel cover 54. When the cleaning brush is placed in the inner barrel 521, the barrel body 52 moves downward with respect to the seat body 51 against the elastic force of the elastic element 53, so as to drive the barrel cover 54 to be closed at the upper end of the seat body 51 and enable the vent hole 5121 to communicate the inner barrel 521 with the outside of the seat body 51.

Specifically, the elastic element 53 is a spring. Both ends of the spring abut against the bottom of the inner barrel 521 and the base 511, respectively. The elastic force of the spring should be less than the sum of the gravity of the cleaning brush and the barrel body 52, but greater than the gravity of the barrel body 52. That is, when the cleaning brush is placed in the barrel body 52, the barrel body 52 moves downward so that the spring is in a compressed state, and when the cleaning brush is taken out, the spring resets to drive the barrel body 52 to move upward.

The seat body 51 comprises a base 511 and a bracket 512 placed on the base 511. The air vent 5121 is provided at the upper part of the bracket 512. The bucket cover 54 is hinged to the upper end of the bracket 512. The inner barrel 521 is sleeved inside the bracket 512. A mounting block 513 extends outward from the side end of the bracket 512. The barrel body 52 is provided with an escaping groove into which the mounting block 513 protrudes. The socket 5131 is provided in the mounting block 513. The lower part of the bracket 512 is provided with a through hole 5122. When the cleaning brush is lifted upward, the barrel body 52 moves upward with respect to the base 51 under the action of the elastic force of the elastic element, so that the through hole 5122 communicates the inside of the base 51 with the outside thereof. The air vent 5121 and the through hole 5122 are provided, so that the barrel body 52 is communicated with the outside air, which is beneficial to the quick draining of the water stains of the cleaning brush and avoids the generation of peculiar smell and bacteria.

The barrel cover 54 is provided with an abutting part 541 corresponding to the hinged end thereof. The barrel body 52 is provided with an inclined surface part 522 which abuts against the abutting part 541 and is matched therewith in a guiding manner. The inclined surface part 522 inclines upward from inside to outside. Through the arrangement, the barrel cover 54 can be opened and closed more stably and smoothly.

The above is only the preferred embodiment of the present disclosure. Therefore, all equivalent changes or modifications made according to the configuration, characteristics and principles described in the patent application scope of the present disclosure are included in the patent application scope of the present disclosure.

What is claimed is:

1. A cleaning brush kit, comprising;

a cleaning brush; and a storage box configured to house the cleaning brush, wherein the storage box has a side wall, the side wall of the storage box is provided with an adsorption member, and the adsorption member enables the storage box to be attached to a smooth surface and a hard surface, the storage box comprises:

a seat body having an upper end and a lower end, a barrel body, wherein the seat body is movably sleeved with the barrel body, the seat body includes:

a base and a bracket having an upper end, a lower end, a first side end and a second side end, the bracket is placed on the base, a mounting block extending outwardly from the second side end of the bracket, wherein the barrel body is provided with an escaping groove configured to receive the mounting block, wherein the storage box includes a socket integrated in the mounting block, the socket has an opening, and the adsorption member is provided with a plug-in block, the plug-in block is configured to be inserted into the socket.

2. The cleaning brush kit according to claim 1, wherein the adsorption member is a suction cup.

3. The cleaning brush kit according to claim 1, wherein the storage box further comprising an elastic element, the elastic element is disposed between the seat body and the barrel body, the seat body has an outer part, the barrel body is provided with an inner barrel placed in the seat body, the inner barrel is provided with an accommodating cavity, wherein the upper end of the seat body is hinged with a barrel cover, the barrel cover opens and closes as the barrel body moves in a vertical direction, the seat body is provided with an air vent at a lower end of the barrel cover, when the cleaning brush is placed inside the inner barrel, the barrel body moves downward with respect to the seat body against an elastic force produced by the elastic element, to drive the barrel cover to be closed at the upper end of the seat body and enable the air vent to connect the inner barrel with outer part of the seat body.

4. The cleaning brush kit according to claim 3, wherein the air vent is provided at the upper end of the bracket, the barrel cover is hinged to the upper end of the bracket, and the inner barrel is sleeved inside the bracket.

5. The cleaning brush kit according to claim 3, wherein the barrel cover is provided with an abutting part corresponding to a hinged end thereof, wherein the barrel body is provided with an inclined surface part which abuts against the abutting part and is matched therewith in a guiding manner, and wherein the inclined surface part inclines upward from inside to outside.

6. The cleaning brush kit according to claim 1, wherein the cleaning brush further comprising a brush handle, a brush head having an upper surface and a lower surface, the brush head is connected to the brush handle, and a plurality of bristles having a predefined cross section, the plurality of bristles are attached on the upper surface of the brush head and lower surface of the brush head.

7. The cleaning brush kit according to claim 6, wherein the brush head is flat, and the cross section of the plurality of bristles are perpendicular to the upper surface of the brush head and the lower surface of the brush head.

8. The cleaning brush kit according to claim 6, wherein the cross sections of the plurality of bristles attached on the on the upper surface of the brush head and lower surface of the brush head of the brush head are polygonal.

9. The cleaning brush kit according to claim 6, wherein the cross section of the plurality of bristles is rectangular.

* * * * *